US012458145B2

(12) United States Patent
Thorwesten

(10) Patent No.: US 12,458,145 B2
(45) Date of Patent: Nov. 4, 2025

(54) SWIVEL FITTING OF SEATING FURNITURE FOR ADJUSTING A FOOT PART AND SEATING FURNITURE WITH ADJUSTABLE FOOT PART

(71) Applicant: Ferdinand Lusch GmbH, Schloss Holte-Stukenbrock (DE)

(72) Inventor: Andreas Thorwesten, Hoevelhof (DE)

(73) Assignee: Ferdinand Lusch GmbH, Schlosse Holte-Stukenbrock (DE)

( * ) Notice: Subject to any disclaimer, the term of this patent is extended or adjusted under 35 U.S.C. 154(b) by 377 days.

(21) Appl. No.: 17/899,002

(22) Filed: Aug. 30, 2022

(65) Prior Publication Data

US 2023/0076546 A1 Mar. 9, 2023

(30) Foreign Application Priority Data

Aug. 31, 2021 (DE) ..... 10 2021 122 430.6

(51) Int. Cl.
*A47C 1/034* (2006.01)
*A47C 7/50* (2006.01)

(52) U.S. Cl.
CPC ..... *A47C 1/0345* (2013.01)

(58) Field of Classification Search
CPC ..... A47C 1/0345
See application file for complete search history.

(56) References Cited

U.S. PATENT DOCUMENTS 4,108,491 A * 8/1978 Rogers, Jr. ..... A47C 1/0355 297/86
4,350,387 A * 9/1982 Rogers, Jr. ..... A47C 1/0355 297/322

(Continued)

FOREIGN PATENT DOCUMENTS

CN 111820648 A 10/2020
DE 8904319 U1 5/1989

(Continued)

*Primary Examiner* — Robert Canfield
(74) *Attorney, Agent, or Firm* — The Webb Law Firm

(57) ABSTRACT

Described and represented is a swivel fitting of seating furniture for adjusting a foot part from a retracted non-use position to an extended use position, with a mounting section for mounting on a chassis of the seating furniture, with a foot part section for mounting the foot part, with a foot part fitting for adjusting the foot part, wherein the foot part section has a front foot part connection swivel region in the use position and a rear foot part connection swivel region in the non-use position and a rear foot part connection tilt region in the use position and a front foot part connection tilt region in the non-use position, and wherein the foot part connection swivel region and the foot part connection tilt region are held via an adjusting lever and a control lever of the foot part fitting and are adjustable relative to one another. In order to better take into account the requirements placed on seating furniture and at the same time to manufacture the swivel fitting quite cost-effectively and use it reliably, it is provided that, during the entire adjustment from the non-use position to the use position and back, the adjusting lever and the control lever are arranged extending adjacent to one another in a common longitudinal section, which extends at least over 20 cm in the longitudinal direction of the swivel fitting, in a direction at least substantially perpendicular to the adjusting lever and/or to the control lever, in that the longitudinal section in the use position is arranged in front of the foot part connection tilt region in the non-use position and in that in the longitudinal section, the longitudinal extension of the adjusting lever is inclined by less than 15° with respect to the longitudinal extension of the control lever.

19 Claims, 12 Drawing Sheets

(56) References Cited

U.S. PATENT DOCUMENTS

| | | | | |
|---|---|---|---|---|
| 4,418,957 | A * | 12/1983 | Rogers, Jr. | A47C 1/0355 297/322 |
| 5,084,062 | A | 1/1992 | Sturm | |
| 5,087,094 | A * | 2/1992 | Rogers, Jr. | A47C 1/0355 297/69 |
| 5,088,789 | A * | 2/1992 | LaPointe | A47C 7/506 297/69 |
| 10,376,060 | B2 * | 8/2019 | Marcantoni | A47C 1/0342 |
| 10,610,024 | B2 | 4/2020 | Carrera | |
| 10,842,274 | B1 * | 11/2020 | Crawford | A47C 1/0345 |
| 11,452,378 | B1 * | 9/2022 | Li | A47C 1/03211 |
| 11,903,485 | B1 * | 2/2024 | Lawson | A47C 1/0355 |
| 12,201,218 | B2 * | 1/2025 | Lawson | A61G 5/14 |
| 2008/0290710 | A1 * | 11/2008 | Lawson | A47C 1/0345 297/337 |
| 2014/0049084 | A1 * | 2/2014 | Lawson | A47C 1/032 297/340 |
| 2015/0054315 | A1 * | 2/2015 | Donovan | A47C 1/0345 297/325 |
| 2016/0029800 | A1 * | 2/2016 | Bryant | A47C 1/0242 297/284.3 |
| 2016/0073785 | A1 * | 3/2016 | Mackert | A47C 1/0345 297/423.19 |
| 2016/0088942 | A1 * | 3/2016 | Murphy | A47C 1/0345 297/361.1 |
| 2018/0206644 | A1 * | 7/2018 | Murphy | A47C 3/18 |
| 2019/0061569 | A1 * | 2/2019 | Bowen | B60N 2/2252 |
| 2019/0082850 | A1 * | 3/2019 | Carrera | A47C 7/503 |
| 2019/0216221 | A1 * | 7/2019 | Bryant | A47C 1/023 |
| 2019/0357681 | A1 * | 11/2019 | Fei | A47C 1/037 |
| 2020/0015596 | A1 | 1/2020 | Carrera | |
| 2021/0219727 | A1 * | 7/2021 | Zhang | A47C 3/20 |
| 2022/0039558 | A1 * | 2/2022 | Zhang | A47C 7/5068 |
| 2022/0087431 | A1 * | 3/2022 | Zhang | A47C 7/5068 |
| 2022/0312967 | A1 * | 10/2022 | Schuster | A47C 1/034 |
| 2022/0312968 | A1 * | 10/2022 | Schuster | A47C 1/0345 |
| 2024/0023713 | A1 * | 1/2024 | Murphy | A47C 1/0345 |
| 2024/0108136 | A1 * | 4/2024 | Crum | A47C 1/0355 |
| 2025/0000260 | A1 * | 1/2025 | Cai | A47C 1/0355 |
| 2025/0072611 | A1 * | 3/2025 | Tsay | A47C 1/037 |

FOREIGN PATENT DOCUMENTS

| | | | |
|---|---|---|---|
| DE | 202017105693 | U1 | 9/2017 |
| DE | 202018104073 | U1 | 8/2018 |
| EP | 0396561 | B1 | 11/1994 |
| EP | 3412176 | B1 | 1/2020 |
| EP | 3420854 | B1 | 12/2021 |

* cited by examiner

SWIVEL FITTING OF SEATING FURNITURE FOR ADJUSTING A FOOT PART AND SEATING FURNITURE WITH ADJUSTABLE FOOT PART

CROSS-REFERENCE TO RELATED APPLICATION

This application claims priority to German Patent Application No. 10 2021 122 430.6 filed Aug. 31, 2021, the disclosure of which is hereby incorporated by reference in its entirety.

BACKGROUND OF THE INVENTION

Field of the Invention

The invention relates to a swivel fitting of seating furniture for adjusting a foot part from a retracted non-use position to an extended use position, with a mounting section for mounting on a chassis of the seating furniture, with a foot part section for mounting the foot part, with a foot part fitting for adjusting the foot part, wherein the foot part section has a front foot part connection swivel region in the use position and a rear foot part connection swivel region in the non-use position and a rear foot part connection tilt region in the use position and a front foot part connection tilt region in the non-use position, wherein the foot part connection swivel region and the foot part connection tilt region are held via an adjusting lever and a control lever of the foot part fitting and are adjustable relative to one another and wherein, during the entire adjustment from the non-use position to the use position and back, the adjusting lever and the control lever are arranged extending adjacent to one another in a common longitudinal section, which extends at least over 20 cm in the longitudinal direction of the swivel fitting, in a direction perpendicular to the adjusting lever and/or to the control lever. The invention further relates to seating furniture with a chassis, two side bolsters and at least one swivel fitting, wherein the swivel fitting is mounted on the chassis via a mounting section and wherein the side bolsters are connected via a stationary and continuous panel.

Description of Related Art

Swivel fittings for adjusting foot parts of seating furniture are already known in different configurations. Typically, the foot part of corresponding seating furniture can be positioned in a non-use position below the seat of the seating furniture. From this position, the foot part can then be adjusted forwards and upwards to a use position in which the user of the foot part can rest their feet or legs on the foot part. The swivel fittings for adjusting the foot part are mounted on a chassis of the seating furniture via a mounting section. The chassis is thereby a supporting structure of the seating furniture with respect to which the foot part can be relatively adjusted. In a simple configuration of the seating furniture, the chassis comprises side bolsters that can stand on the ground. It is then advisable to fix the mounting section, which is designed in a plate shape as required, on a side bolster of the chassis. Two swivel fittings are usually fixed on the opposing sides of the chassis or the opposing side bolsters. This prevents the foot part tilting and provides a more robust foot part.

In the case of the known swivel fittings, the foot part is fixed to a foot part section, wherein the foot part is formed by at least one board upholstered, in particular padded, with a cover. The foot part section can then be adjusted via a foot part fitting. To enable the foot part to be positioned at a greater distance from the ground in the non-use position and thus enable the seating furniture to have greater ground clearance, the foot parts are partly designed in two parts and the two parts of the foot part are swivelled relative to one another when the foot part is adjusted. Both parts of the foot part can then be mounted on other flanges of the foot part section. The two parts of the foot part are in this case usually swivelled to different extents.

A part of the foot part that is to be swivelled to a greater extent can be mounted on a foot part connection swivel region and a part of the foot part that is to only be tilted can be mounted on a foot part connection tilt region. In the non-use position, the foot part connection swivel region and the part of the foot part mounted thereon are arranged in a rear position, while the foot part connection tilt region with the part of the foot part mounted thereon is arranged in a front position. The part of the foot part provided on the foot part connection swivel region is usually not visible from the outside in the use position, while the part of the foot part mounted on the foot part connection tilt region usually forms a front panel of the seating furniture under the seat, which generally prevents the user from seeing under the seat and seeing the swivel fitting there. In the use position, on the other hand, the foot part connection tilt region with its part of the foot part is arranged in a rear position in which, for example, the legs of the user can be placed on the corresponding part of the foot part. The foot part connection swivel region, on the other hand, is arranged in a front position in the use position. Then, for example, the user can place their feet on the part of the foot part connected to the foot part connection swivel region.

The foot part connection swivel region and the foot part connection tilt region are held in the use position via an adjusting lever and a control lever of the foot part fitting and supported on the chassis of the seating furniture. In order to swivel the foot part connection swivel region and the foot part connection tilt region relative to one another, the adjusting lever and the control lever are provided so as to be adjustable relative to one another, namely while the foot part is adjusted from the non-use position to the use position and back. In this case, the adjusting lever and the control lever can be designed as part of a so-called scissor gear and arranged adjacent to one another.

The swivel fittings known from the prior art are often designed quite complexly and therefore cost-intensively and in some cases are prone to failure. Simpler and more cost-effectively designed swivel fittings, on the other hand, typically do not meet high aesthetic and functional requirements. In most cases, the swivel fittings take up a large space in the non-use position and when adjusting the foot part and therefore usually do not allow large ground clearances for the seating furniture.

SUMMARY OF THE INVENTION

Therefore, the object underlying the present invention is to design and further develop the swivel fitting and the seating furniture in each case of the type mentioned at the outset and previously explained in more detail in such manner that the high aesthetic and functional requirements placed on seating furniture can be better taken into account, while at the same time the swivel fitting can be manufactured very cost-effectively and used reliably.

This object is achieved in the case of a swivel fitting in that, during the entire adjustment from the non-use position to the use position and back, the adjusting lever and the control lever are arranged extending adjacent to one another in a common longitudinal section, which extends at least over 20 cm, in a direction at least substantially perpendicular to the adjusting lever and/or to the control lever, in that the longitudinal section in the use position is arranged in front of the foot part connection tilt region in the non-use position and in that in the longitudinal section, the longitudinal extension of the adjusting lever is inclined by less than 15° with respect to the longitudinal extension of the control lever.

The object mentioned above is further achieved in the case of seating furniture as described herein in that the swivel fitting is designed according to any one of claims 1 to 14 and in that the foot part section in the non-use position is arranged at least in sections in a horizontal direction behind the panel.

The invention has recognized that the swivel fitting together with the foot part in the use position can be designed to be particularly compact and effective. This is implemented according to the invention to a particularly effective extent in that, during the entire adjustment from the non-use position to the use position and back, the adjusting lever and the control lever extend in approximately the same longitudinal direction of the swivel fitting. In this case, the adjusting lever and the control lever extend adjacent to one another in a common longitudinal section in the longitudinal direction of the swivel fitting over at least 20 cm. The longitudinal section in this case extends at least substantially perpendicular to the adjusting lever and/or to the control lever. In this way, the foot part can, on the one hand, be arranged in a comfortable position far in front of the seat of the seating furniture, wherein only a very low installation height is required. This would, for example, not be possible or at most with considerable additional effort, if instead a scissor gear were used in which the scissor levers are swivelled wide relative to one another and therefore do not extend over a wide longitudinal section adjacent to one another at least substantially in the same direction.

The aforementioned advantages thereby result to a particular extent also because the longitudinal section is arranged in the use position in a region which, if the foot part were in the non-use position, would be positioned in front of the foot part connection tilt region of the foot part section. This ultimately means that the part of the foot part fitting that is to be extended can be extended beyond a stationary panel below the seat of the seating furniture. At the same time, however, the swivel fitting can also be designed to be so compact such that the swivel fitting can be placed behind such a panel in the non-use position, even if this panel only has a fairly low height. This is not only aesthetically pleasing, but also allows the seating furniture to have a high ground clearance.

In this case, the swivel fitting, the foot part section and/or the foot part connection swivel region do not necessarily, in particular not completely, have to be provided at the height of the panel. It is also conceivable and expedient if the swivel fitting, the foot part section and/or the foot part connection swivel region are provided in the horizontal direction behind the panel and in the vertical direction, if necessary partially, above the panel.

In the longitudinal section, the adjusting lever and the control lever run at least substantially parallel to one another for the aforementioned reasons. However, a certain angle between the adjusting lever and the control lever may be desirable in order to be able to adjust the foot part section in a simple and reliable manner. This can then be done very easily if the adjusting lever and the control lever are adjusted relative to one another at least substantially in the longitudinal direction by the control lever, adjusting lever and/or swivel fitting. It is a good compromise here between simplicity and reliability, on the one hand, and compactness, on the other hand, if the angle between the adjusting lever and the control lever in the longitudinal section is less than 15°.

In this context, the angle can be determined as required such that the articulated attachment points of the adjusting lever and of the control lever are first connected with a straight line. The angle between these straight lines can then be determined. However, it is also advisable if the angles of the actual course of the adjusting lever and of the control lever do not form an angle of greater than 15° in order to provide the most compact possible design. However, short sections in which the angle is greater, do not also directly lead to the aforementioned advantage according to the invention not being achieved, in particular as long as the foot part fitting does not collide with the panel of the seating furniture.

The swivel fitting and the seating furniture are described together below for the sake of clarity and to avoid unnecessary repetitions, without distinguishing in each case in detail between the swivel fitting and the seating furniture. For the person skilled in the art, however, the context determines which features are particularly preferred for the swivel fitting and the seating furniture in each case.

In a first particularly preferred configuration of the swivel fitting, the longitudinal section extends over at least 25 cm, preferably over at least 30 cm, in particular over at least 35 cm. The longer the longitudinal section extends, the more compact and simpler the swivel fitting can be designed. Compactness can thereby be achieved not only in the use position, but also in the non-use position. In this case, the foot part fitting also generally requires less installation space in order to enable adjustment of the foot part fitting over a front panel below the seat. In principle, this panel can also be designed lower the longer the longitudinal section extends. However, it must also be taken into account that the extension of the longitudinal section beyond a certain length no longer offers any additional advantages. For example, this can be from around 50 cm or even from shorter lengths, as the leg length of the user is also finite. However, the exact lengths depend on various factors, in particular on the desired position of the user on the seating furniture with the foot part in the use position.

The compactness of the swivel fitting and the associated advantages already described above can alternatively or additionally also be reinforced in that in the longitudinal section, the longitudinal extension of the adjusting lever is inclined by less than 12°, preferably less than 10°, in particular less than 8°, with respect to the longitudinal extension of the control lever. The lower the inclination of the adjusting lever and control lever, the more parallel the adjusting lever and control lever will run. As a result, the control lever and the adjusting lever require or occupy less installation space, in particular less installation height, at least in the longitudinal section. In order to improve the compactness of the swivel fitting, the adjusting lever and the control lever are arranged next to one another rather than on top of one another in relation to the seating furniture. In other words, the adjusting lever and the control lever are spaced apart from one another at least substantially in the horizontal direction and only at best in the vertical direction to a limited extent.

For an expedient adjustment of the swivel fitting despite the compact design of the foot part fitting, it is advisable if the foot part connection tilt region, the foot part connection swivel region, the adjusting lever and the control lever are connected to one another via a five-bar linkage. This ultimately allows very precise adjustment of the foot part fitting in the small installation space available for adjustment. This is particularly the case if the five-bar linkage has a handle lever which connects the control lever directly to the foot part connection swivel region by bypassing the foot part connection tilt region. In this way, the foot part connection swivel region can be swivelled widely such that the foot part section can be arranged in a very space-saving manner in the non-use position. In this way, it can also be achieved that the foot part section does not adopt the most space-saving configuration in the non-use position, but only when the foot part is adjusted to a certain extent in the direction of the use position.

In order to simplify the adjustment of the foot part and thus of the foot part fitting, the foot part fitting can, if required, be fixed to the mounting section so as to be adjustable via a tilt fitting for tilting the foot part fitting with respect to the mounting section. In this way, the swivel fitting can also be divided at least functionally into a tilt fitting and a foot part fitting. The tilt fitting does not thereby primarily adjust the foot part section, but primarily enables the foot part fitting to be adjusted from the non-use position in order to enable efficient adjustment of the foot part fitting and thus of the foot part section. In this case, the foot part fitting is fixed to the mounting section via the tilt fitting. Consequently, the foot part fitting can be adjusted via the tilt fitting with respect to the mounting section and thus with respect to the chassis. In this context, it is particularly expedient and simple if the mounting section is designed as part of the tilt fitting. The coupling strut can expediently raise the front region of the foot part fitting with respect to the chassis.

It may be particularly simple and reliable if the mounting section and the tilt fitting form a four-bar linkage. This allows a wide and stable tilting of the foot part fitting. In terms of design, this is easy to achieve if the four-bar linkage comprises two tilting levers and a connecting lever. The tilt fitting can then be connected via the connecting lever to a back fitting for adjusting a backrest from a more upright position to a flatter position relative to the chassis and back. However, this is also expedient if the tilt fitting is not designed as a four-bar linkage and/or the back fitting is not connected to the tilt fitting via the connecting lever. The backrest can then be easily adjusted by way of the back fitting, more or less independently of the adjustment of the foot part fitting and/or the tilt fitting as required.

In order to ensure simple and at the same time very precise and reliable adjustment of the swivel fitting, the tilt fitting for tilting the foot part fitting can be motor-driven. Alternatively or additionally, it is also expedient for the same reason if the back fitting for adjusting the backrest is motor-driven, provided that the swivel fitting is provided with a back fitting. To simplify the swivel fitting, it is useful here if the tilt fitting and the back fitting are driven together, in particular via a common motor. This is particularly expedient if the tilt fitting and the back fitting are adjusted at least substantially after one another in a motor-driven manner. When adjusting the foot part from the non-use position to the use position, tilting can therefore first take place via the tilt fitting and then, in particular not immediately, but only after partial adjustment of the foot part fitting, the backrest is adjusted, in particular from the more upright position to the flatter position.

For the expedient connection and integration of the foot part fitting to or into the swivel fitting, it is advisable if the tilt fitting or the back fitting with the seat fitting has a common coupling strut. This also makes it possible in a constructively simple manner to adjust the foot part fitting and the tilt fitting and/or the back fitting at least substantially independently of one another. For the sake of design simplicity and/or increased comfort for the user, it may be advisable if a seat section for mounting the seat on the swivel fitting is provided stationarily in relation to the coupling strut. In order for the seat to be held in a tilt-resistant manner by the coupling strut, it may, if necessary, be advisable if the seat section is designed in two parts and if the two parts of the seat section are provided on the coupling strut spaced apart from one another in the longitudinal extension of the coupling strut. Furthermore, it is advisable if the seat section is provided so as to be adjustable relative to the chassis via the swivel fitting and thus via the coupling strut.

Good functionality and a simple design result, for example, when the back fitting connects the connecting lever to the coupling strut via a four-bar linkage and a five-bar linkage one after the other. In this way, a corresponding decoupling between the adjustment of the foot part, the seat and/or the backrest can also be achieved. The same advantages can, for example, be achieved alternatively or additionally if a back section for mounting a backrest is connected to the coupling strut via a four-bar linkage.

In order to synchronize the adjustment of the swivel fitting, the four-bar linkage for connecting the back section to the coupling strut and the five-bar linkage for connecting the connecting lever to the coupling struts can then have a common transmission lever. This achieves a defined and reliable adjustment of the swivel fitting as a whole.

Irrespective of this, the foot part fitting can be connected to the coupling strut via a five-bar linkage. In this way, the space-saving and correspondingly precise adjustment of the foot part can be expediently achieved. This is particularly the case when the five-bar linkage is connected to the coupling strut with two parallel levers, which are always aligned at least substantially parallel to one another. This also ensures a particularly stable connection of the foot part fitting to the coupling strut.

In order to achieve precise and space-saving adjustment of the foot part, it is also advisable if each of the parallel levers is connected to the adjusting lever via two articulated connections, namely via a separate drive lever. This drive lever can then at least partially control the drive of the foot part section. In order to ensure stable and reliable adjustment of the foot part section, the two drive levers can be connected to a common spacer lever via two articulated connections. This spacer lever thereby holds the drive levers and thus also the parallel levers at a predetermined distance from one another, which can be used to synchronize the adjustment of the swivel fitting.

For targeted and space-saving adjustment of the foot part section, it is advisable to design a drive lever at least substantially Z-shaped. An upper leg of the drive lever can then be assigned to the adjusting lever, while a lower leg of the drive lever can be assigned to the associated parallel lever. The central leg of the drive lever then connects the upper leg to the lower leg. In this case, the connection region of the central leg with the upper leg is fixed to the control lever in an articulated manner. Despite an approximately parallel extension of the adjusting lever and control lever, this allows an expedient adjustment of the foot part section and in particular of the foot part connection swivel region relative to the foot part connection tilt region.

In addition, the connection region of the central leg and of the lower leg can be fixed to the spacer lever in an articulated manner. This also enables targeted and expedient adjustment of the foot part. This can also support the foot part section only adopting the most compact arrangement after a partial adjustment of the foot part fitting. The same is alternatively or additionally supported by a joint, in particular the joint with the spacer lever, of the five-bar linkage of the foot part fitting being provided on the connection region of the central leg and of the lower leg.

In order to ensure a simple and at the same time very precise and reliable adjustment of the swivel fitting, the foot part fitting for adjusting the foot part can be motor-driven. This is particularly the case and also allows adjustment of the foot part, seat and backrest independently in large parts if the foot part fitting is adjusted via a different motorized drive than the tilt fitting and/or the back fitting. In order to simplify the swivel fitting, it is also advisable here if the foot part fitting is driven via a motorized foot part drive and the tilt fitting and/or the back fitting is driven via a motorized tilt and/or back drive. Consequently, the tilt fitting and the back fitting can be driven at least substantially via a common, separate motorized drive.

In a first particularly preferred configuration of the seating furniture, the swivel fitting is arranged in the use position above the fixed panel extending in particular from a side bolster to the opposing side bolster of the seating furniture. The swivel fitting is therefore provided above the panel in the vertical direction in the use position. This enables a compact design, wherein the panel can be used to stiffen the seating furniture. In order that the seating furniture can be adjusted to the use position conveniently for the user, it is advisable if, in the use position, the longitudinal section is arranged above the panel.

Alternatively or additionally, two swivel fittings can be provided, namely on two opposing sides of the chassis. The swivel fittings are also fixed on the opposing sides of the chassis. In this way, jamming of the swivel fitting can be avoided and large forces can be dissipated without the swivel fittings having to be formed particularly solidly. For the aforementioned reasons, it is advisable if both swivel fittings are designed according to any one of claims 1 to 14. In this case, the swivel fittings expediently interact in such manner that the foot part sections together support a foot part. This takes place in particular such that the foot part in the non-use position is arranged at least in sections in the horizontal direction behind the panel of the seating furniture. For the sake of simplicity and stability of the chassis, the panel can in this case extend from one side bolster to the opposing side bolster below the seat of the seating furniture.

In this context, it is particularly advisable if the two swivel fittings are arranged above the panel in the use position. The swivel fittings are therefore provided above the panel in particular in the vertical direction in the use position. This enables a particularly compact design, wherein the panel can be used for the reinforcement of the seating furniture. In order that the seating furniture can be adjusted to the use position conveniently for the user, it is advisable if the longitudinal sections of the swivel fittings extend beyond the fixed panel.

In order to ensure a simple and at the same time very precise and reliable adjustment of the swivel fitting, it is advisable if a motorized foot part drive coupled to the foot part fitting for adjusting the foot part is provided. Alternatively or additionally, this is achieved by providing a motorized tilt drive connected to the tilt fitting for tilting the foot part fitting.

Irrespective of this, the back fitting for adjusting the backrest can also be coupled to a motorized back drive in order to achieve the aforementioned advantage. However, it is particularly simple and cost-effective if the tilt fitting for tilting the foot part fitting and the back fitting for adjusting the backrest are motor-driven together, albeit if necessary successively, via a common tilt and/or back drive.

BRIEF DESCRIPTION OF THE DRAWINGS

The invention is explained in greater detail below by means of a drawing representing only one exemplary embodiment. The drawing shows.

DESCRIPTION OF THE INVENTION

Figure 1A:
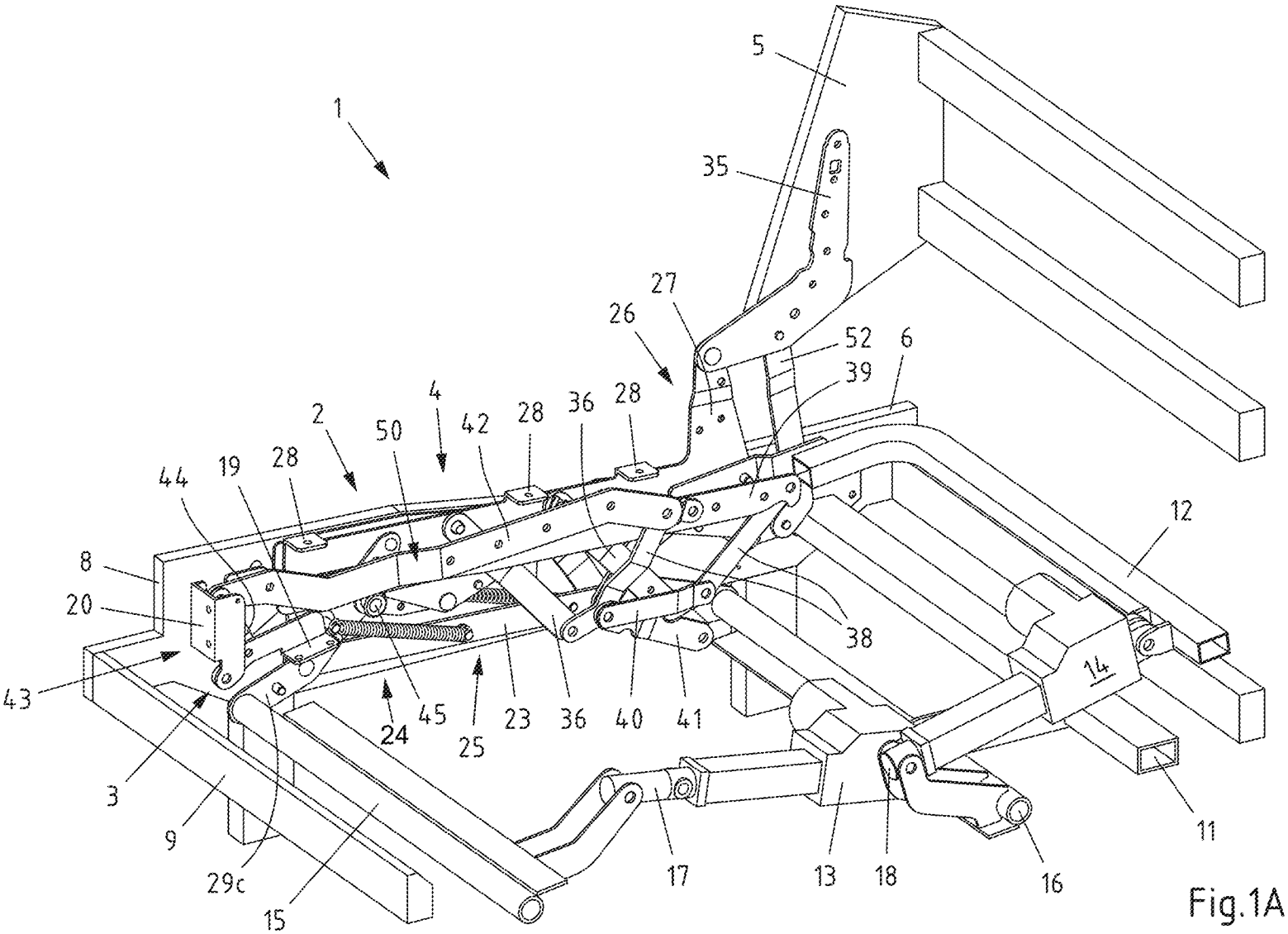
FIGS. 1A-C different details of seating furniture according to the invention with a swivel fitting according to the invention with the foot part in the non-use position in perspective views from above and below and in a side view in relation to the seating furniture, FIGS. 2A-C different details of the seating furniture and of the swivel fitting each from FIG. 1 with the foot part fitting in a position tilted upwards at the front in views corresponding to FIG. 1, FIGS. 3A-C different details of the seating furniture and of the swivel fitting each from FIG. 1 with the foot part fitting in a use position with the backrest in a more upright position in views corresponding to FIG. 1, FIGS. 4A-C different details of the seating furniture and of the swivel fitting each from FIG. 1 with the foot part fitting in a use position with the backrest in a flatter position in views corresponding to FIG. 1.

FIGS. 1A-C to 4A-C represent different details of seating furniture 1 with a swivel fitting 2 for adjusting a foot part 3. Using the swivel fitting 2, the foot part 3 can be adjusted from a non-use position according to FIGS. 1A-C via an intermediate position with the foot part fitting 4 tilted upwards at the front and supporting the foot part 3 according to FIGS. 2A-C into a first use position with a backrest 5 in a more upright position according to FIGS. 3A-C and into a second use position with the backrest 5 in a flatter position according to FIGS. 4A-C and back again.

The swivel fitting 2 is fixed on one side of a chassis 6 of the seating furniture 1. A further swivel fitting 2 is provided on the opposing side of the chassis 6, but this is not represented here. The chassis 6 of the seating furniture 1 forms a frame with respect to which a backrest 5, a seat 7 and a foot part 3 can be adjusted using the swivel fittings 2. The chassis 6 in this case comprises side bolsters 8 on opposing sides, which are stationary connected in the front region of the seat 7 with a continuous panel 9 extending from side bolster 8 to side bolster 8. A mounting section 10 of the swivel fittings 2 is connected to the side bolsters 8 of the seating furniture 1 in each case such that the swivel fittings 2 are supported by the side bolsters 8 of the chassis 6.

The chassis 6 also has a cross member 11 which extends from one side bolster 8 to the opposing side bolster 8. For this purpose, the cross member 11 represented and in this respect preferred has stop plates at opposing ends for mounting on the side bolsters 8. A further cross member 12 is fixedly connected to the opposing swivel fittings 2. However, unlike the first-mentioned cross member 11, this cross member 12 is not also stationary connected to the chassis 6, but rather provided so as to be adjustable with respect to the chassis 6 via the swivel fitting 2. The cross member 11 stationary connected to the chassis 6 supports a tilt and back drive 13, while the cross member 12 adjustable with respect to the chassis 6 supports a foot part drive 14. The tilt and back drive 13 and the foot part drive 14 are each connected to a traverse 15, 16, which extend between the swivel fittings 2 and can be adjusted in a motorized manner by extending or retracting drive rods 17, 18.

A foot part section 43 of the swivel fitting 2 for mounting a foot part 3 is arranged behind the panel 9. In this case, the foot part 3 is arranged below the seat 7 of the seating furniture 1 in the non-use position. The seat 7 is in this case provided with a cover, not represented. In addition, the foot part 3 is designed in two parts, for which purpose the swivel fitting 2 has a foot part connection swivel region 19 and a foot part connection tilt region 20, which can be swivelled relative to one another. The foot part connection swivel region 19 and the foot part connection tilt region 20 each support a board 21 of the two-part foot part 3, which can be covered with a cover, not represented.

Figure 1B:
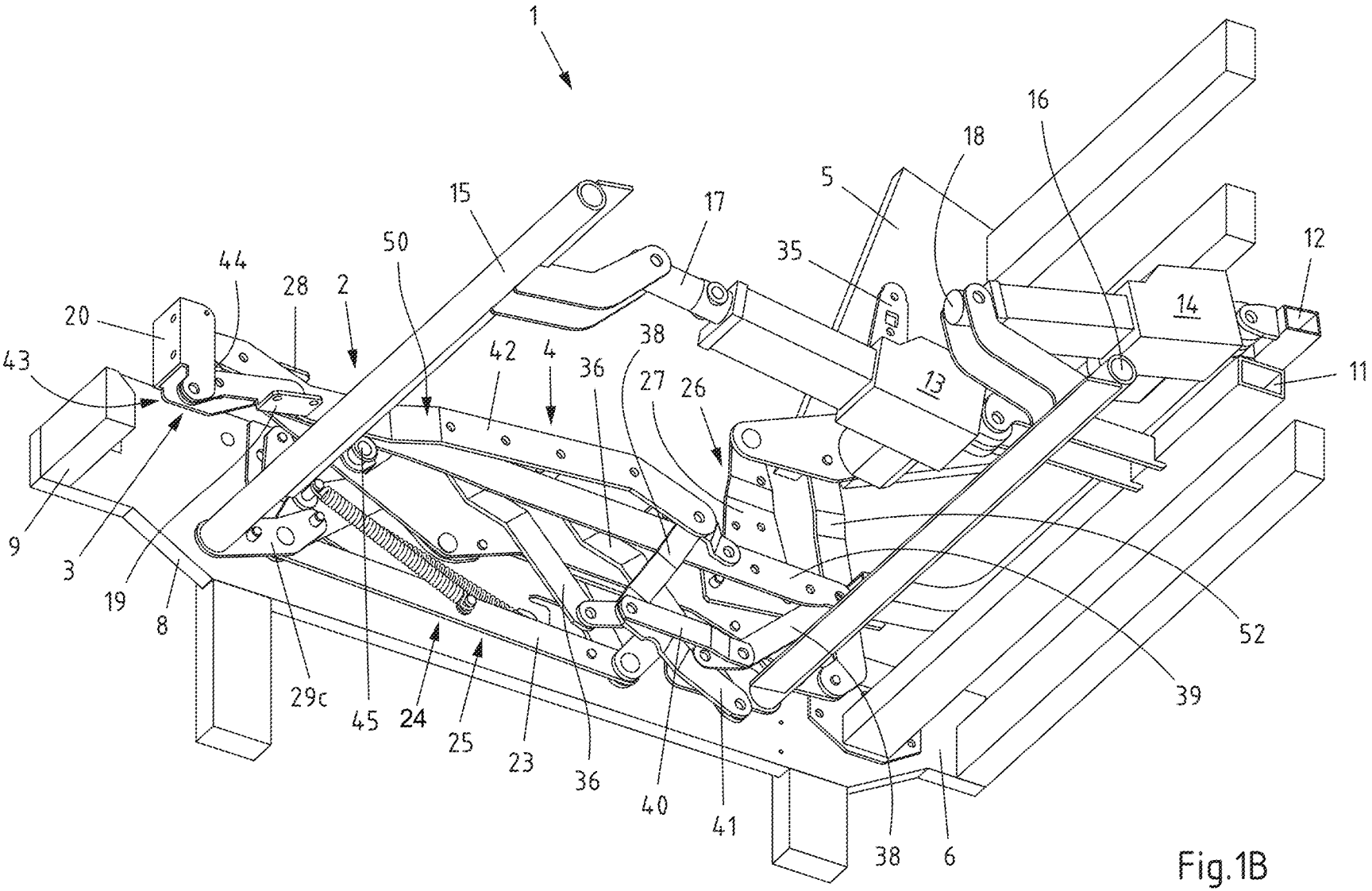
Figure 1C:
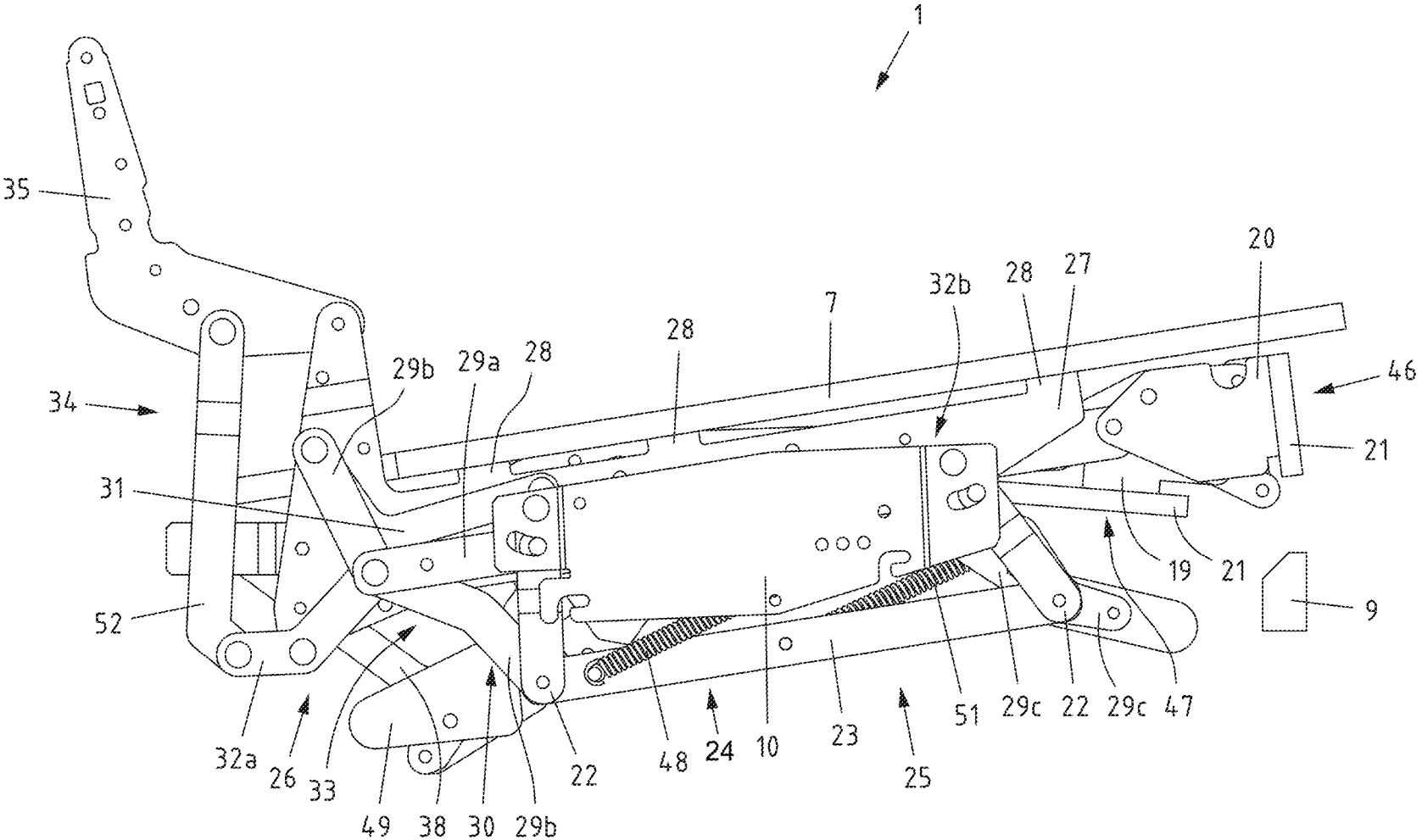
Figure 2A:
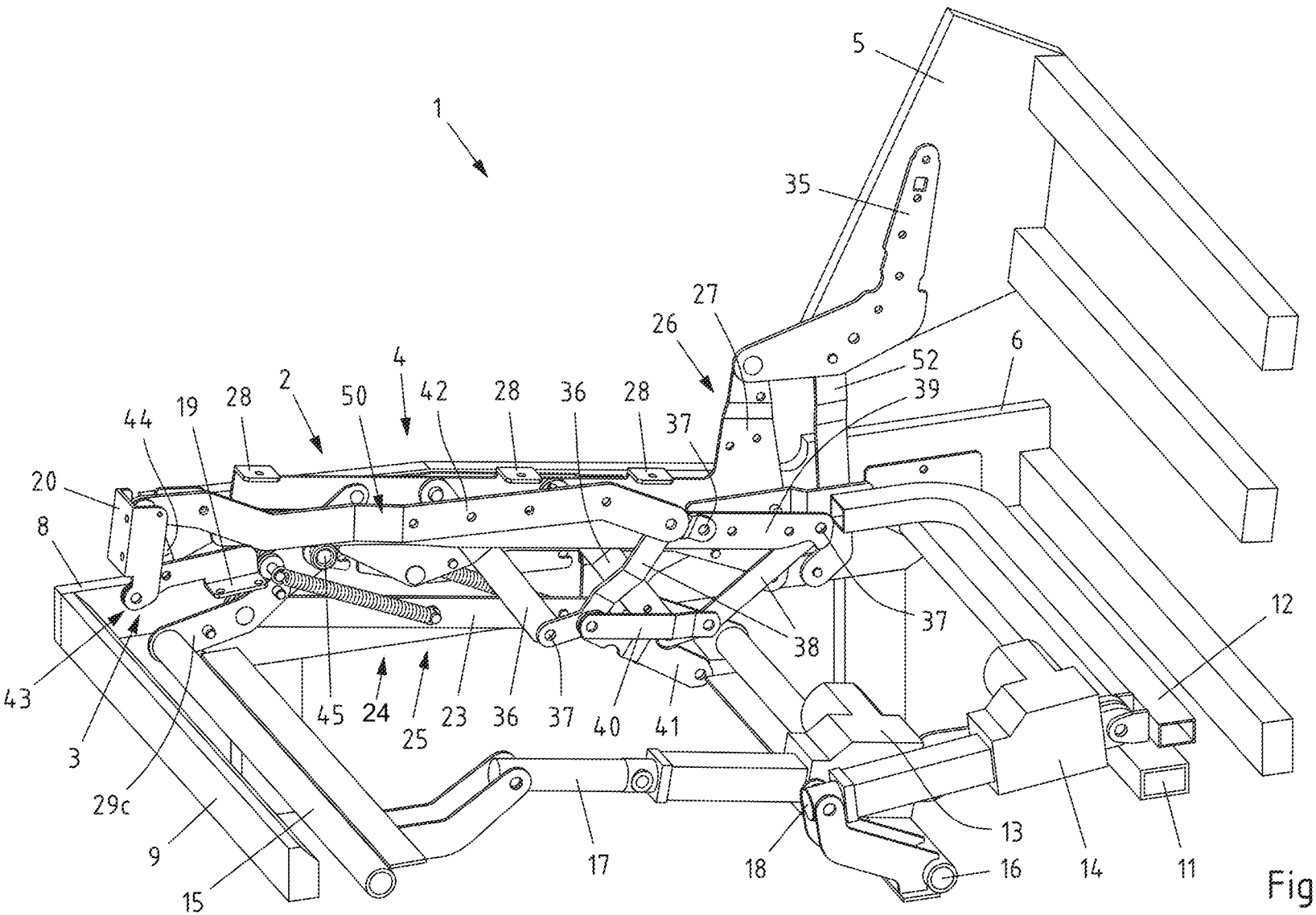
Figure 2B:
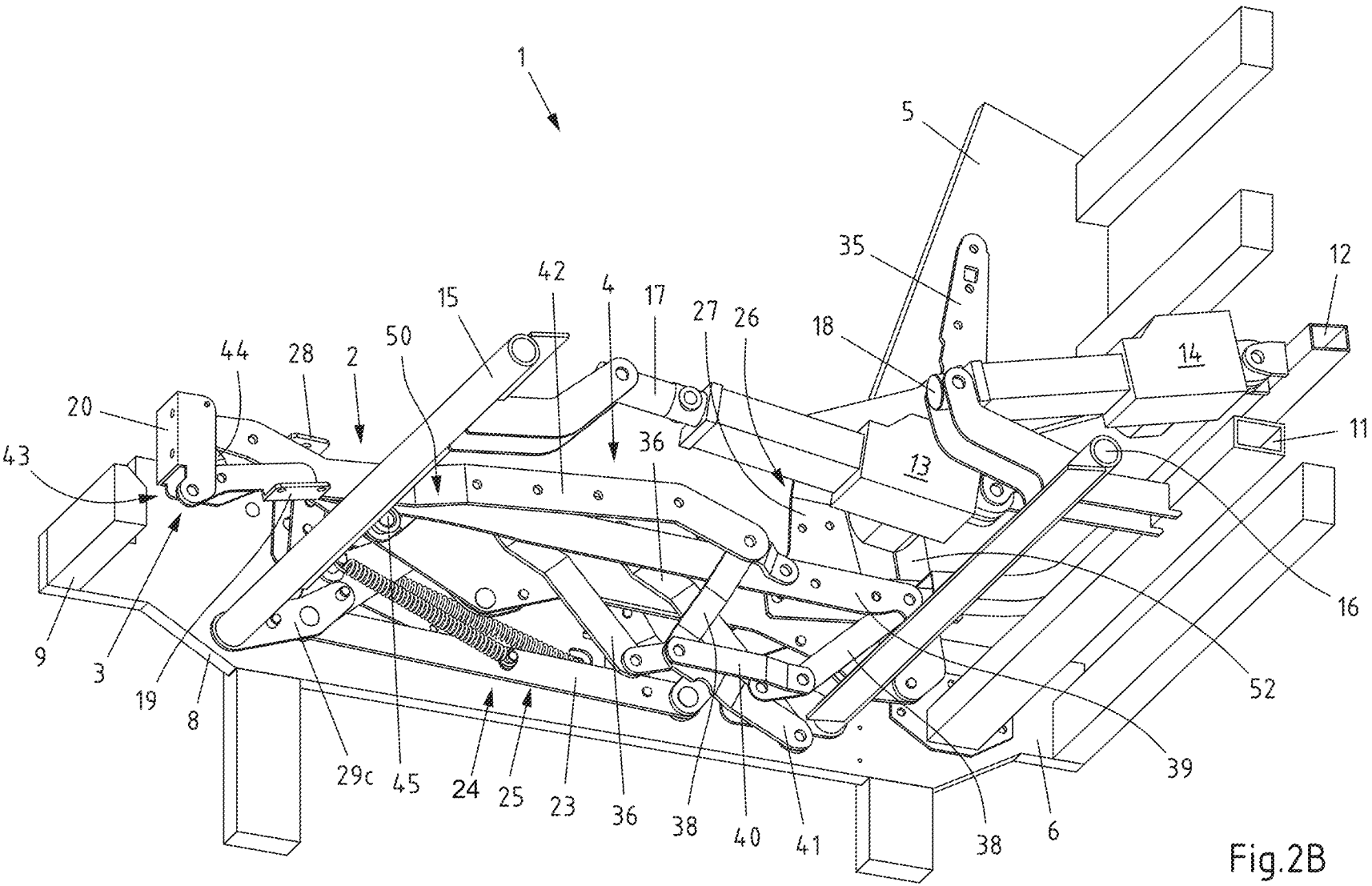
Figure 2C:
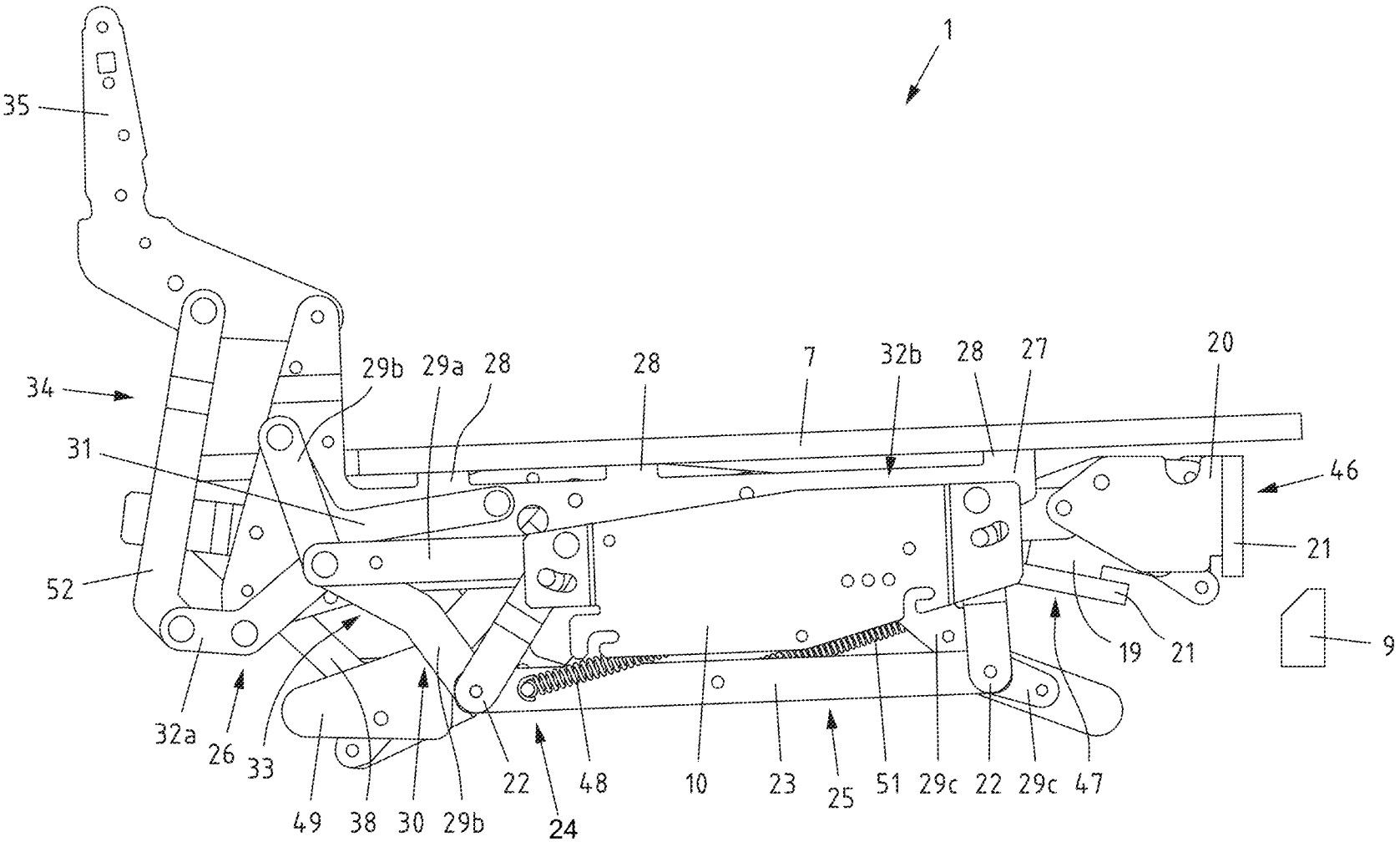

The mounting section 10, together with two tilting levers 22 and a connecting lever 23, forms a four-bar linkage 24 of a tilt fitting 25, with which the foot part fitting 4 according to FIGS. 2A-C can be tilted upwards at the front with respect to the side bolster 8. A back fitting 26 for adjusting the backrest 5 from a more upright position to a flatter position and back again is connected to the mounting section 10 via the connecting lever 23. The back fitting 26 also shares a coupling strut 27 with a foot part fitting 4 for adjusting the foot part 3 from the non-use position according to FIGS. 1A-C into a use position according to FIGS. 3A-C or FIGS. 4A-C. The coupling strut 27 in this case has three seat sections 28 spaced apart from one another in the longitudinal direction of the swivel fitting 2 for mounting the seat 7 stationarily with respect to the coupling strut 27.

The connecting lever 23 forms a four-bar linkage 30 of the back fitting 26 with three swivel levers 29*a*, 29*b*, 29*c*. The upper swivel lever 29*a* extending at least substantially in the longitudinal extension of the swivel fitting 2 is in this case connected to two transmission levers 32*a*, 32*b* to form a four-bar linkage 33 of the back fitting 26, which comprises the coupling strut 27. The swivel lever 29*b* assigned to the rear end of the swivel fitting 2 is connected to the coupling strut 27 via a coupling lever 31. The transmission lever 32*b* assigned to the front end of the swivel fitting 2 is arranged hidden between the mounting section 10 and the coupling strut 27 of the swivel fitting 2. In this case, the four-bar linkage 33 and the four-bar linkage 30 are further connected with the transmission lever 32*a* assigned to the rear end of the swivel fitting 2 to a four-bar linkage 34 supporting the backrest 5. This four-bar linkage 34 comprises the back section 35 for connecting the backrest 5, the coupling strut 27, the transmission lever 32*a* and a support lever 52.

On the side of the coupling strut 27 opposite the back fitting 26, the foot part fitting 4 is hinged on the coupling strut 27 with two parallel levers 36. The two parallel levers 36 in this case run at least substantially parallel to one another during the adjustment of the foot part 3 from the non-use position to the use position. The two parallel levers 36 are each connected to an adjusting lever 39 via two articulated connections 37 via a drive lever 38, wherein the two drive levers 38 are connected to one another via two articulated connections with a spacer lever 40. In addition, the parallel levers 36 are connected to the coupling strut 27 via a tab lever 41 and a drive lever 38 by way of a five-bar linkage. The drive lever 38 of the foot part fitting 4 connected to the tab lever 41 is Z-shaped and therefore has a lower leg, a central leg and an upper leg. The lower leg is connected with a free end to the parallel lever 36 in an articulated manner and with the other end to the tab lever 41 and the spacer lever 40 in an articulated manner. The upper leg is connected with a free end to the adjusting lever 39 in an articulated manner and with the other end to a control lever 42 in an articulated manner.

By connecting the drive levers 38 to the control lever 42 and to the adjusting lever 39, the control lever 42 and the adjusting lever 39 are adjusted with respect to another in order to adjust a foot part section 43 of the foot part fitting 4 supporting the foot part 3. In this case, the adjusting lever 39 is connected to the foot part connection tilt region 20 in an articulated manner, while the control lever 42, on the one hand, is connected to the foot part connection tilt region 20 in an articulated manner and, on the other hand, to a handle lever 44 of the foot part section 43 in an articulated manner. The other end of the handle lever 44 is connected to the foot part connection swivel region 19 in order to swivel the foot part connection swivel region 19 with respect to the foot part connection tilt region 20 from a position behind the foot part connection swivel region 20 to a position in front of the foot part connection tilt region 20 by adjusting the adjusting lever 39 and the control lever 42 relative to one another. For this purpose, the foot part connection swivel region 19 is directly connected to the foot part connection tilt region 20 in an articulated manner.

The adjusting lever 39 and the control lever 42 extend at least substantially parallel and adjacent to one another. In addition, the adjusting lever 39 and the control lever 42 run at least substantially in a horizontal longitudinal direction of the swivel fitting 2, in which the adjusting lever 39 and the control lever 42 are displaced more or less together when the foot part 3 is adjusted from the non-use position to a use position. With the foot part 3 in the non-use position and in the use position, the adjusting lever 39 rests on a support element 45 stationary connected to the coupling strut 27 to deflect the weight forces to the coupling strut 27.

The adjustment of the swivel fitting 2 and of the foot part 3 proceeding from the non-use position according to FIGS. 1A-C will be described in more detail below. In the non-use position, the foot part 3 is arranged together with the foot part section 43 behind the panel 9 of the seating furniture 1, which extends continuously from one side bolster 8 of the chassis 6 of the seating furniture 1 to the opposing side bolster 8. In this case, the front section of the foot part section 43 is formed by the foot part connection tilt region 20, which is arranged in front of the foot part connection swivel region 19. The foot part connection tilt region 20 is in this case arranged such that the part 46 of the foot part 3 supported by the foot part connection tilt region 20 is aligned roughly vertically with the upper side of the foot part 3 pointing forwards. The foot part connection swivel region 19, on the other hand, is aligned such that the part 47 of the foot part 3 supported by the foot part connection swivel region 19 is aligned roughly horizontally with the upper side of the foot part 3 pointing downwards.

In a first step, the tilt and back drive 13 is actuated, wherein the drive rod 17 of the tilt and back drive 13 is partially extended, as represented in FIGS. 2A-C. As a result, the traverse 15 connected to the drive rod 17 and the opposing swivel fittings 2 is adjusted forwards and thereby adjusts the tilt fitting 25 connected to the traverse 15 in the direction of the restoring force of a spring means 48 of the tilt fitting 25. Through the adjustment, the connecting lever 23 is adjusted forwards and upwards by swivelling the tilting levers 22, since the mounting section 10 remains stationary fixed on the side bolster 8 of the seating furniture 1. By correspondingly adjusting the tilt fitting 25, the front section of the foot part fitting 4, comprising the foot part section 43, and the coupling strut 27 together with the seat 7 and the back fitting 26 are raised in the front region. The foot part section 43 is thus adjusted upwards with respect to the panel 9 of the seating furniture 1. However, as a result, the foot part fitting 4 and the back fitting 26 remain arranged substantially unchanged in relation to the coupling strut 27.

Figure 3A:
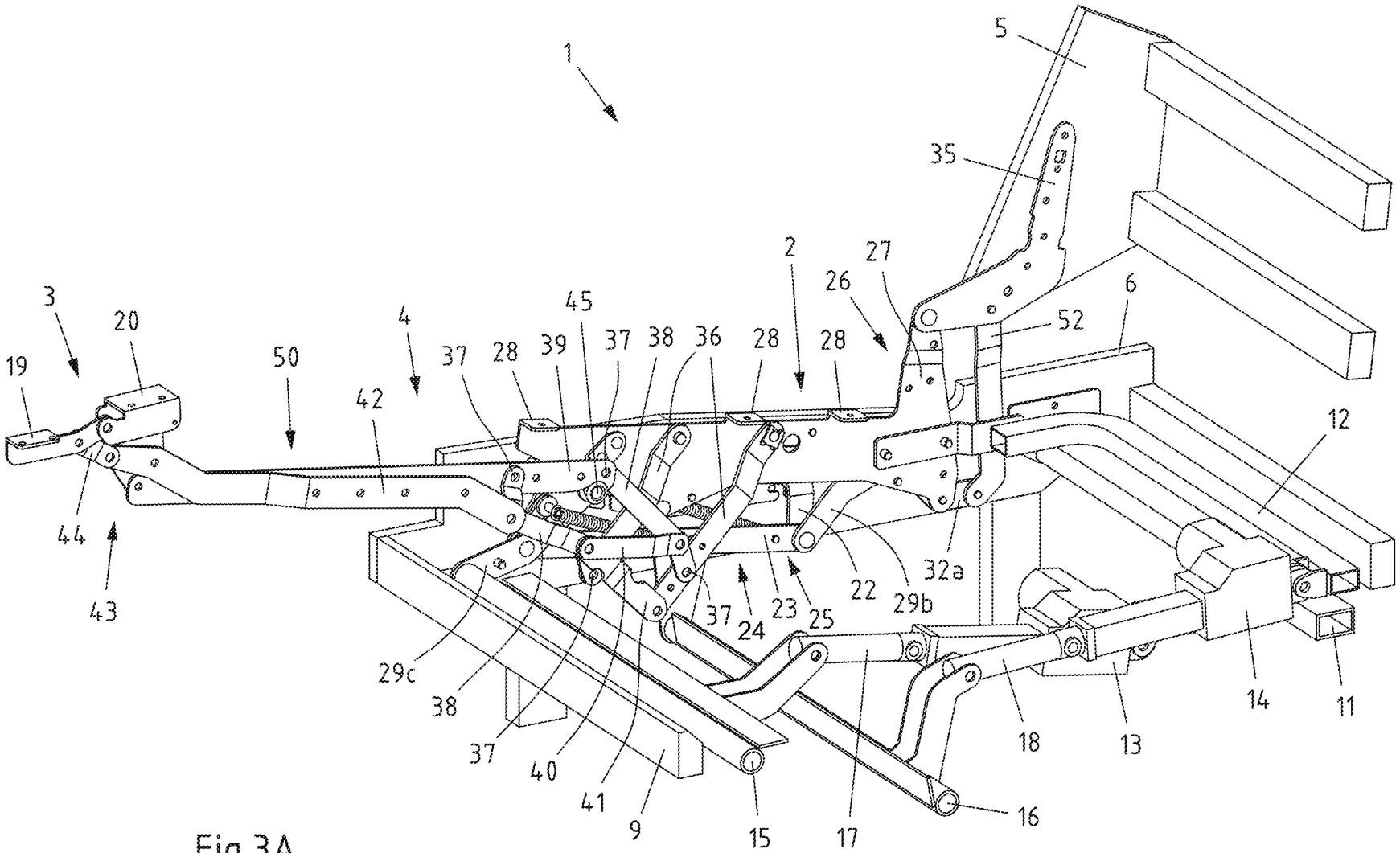
Figure 3B:
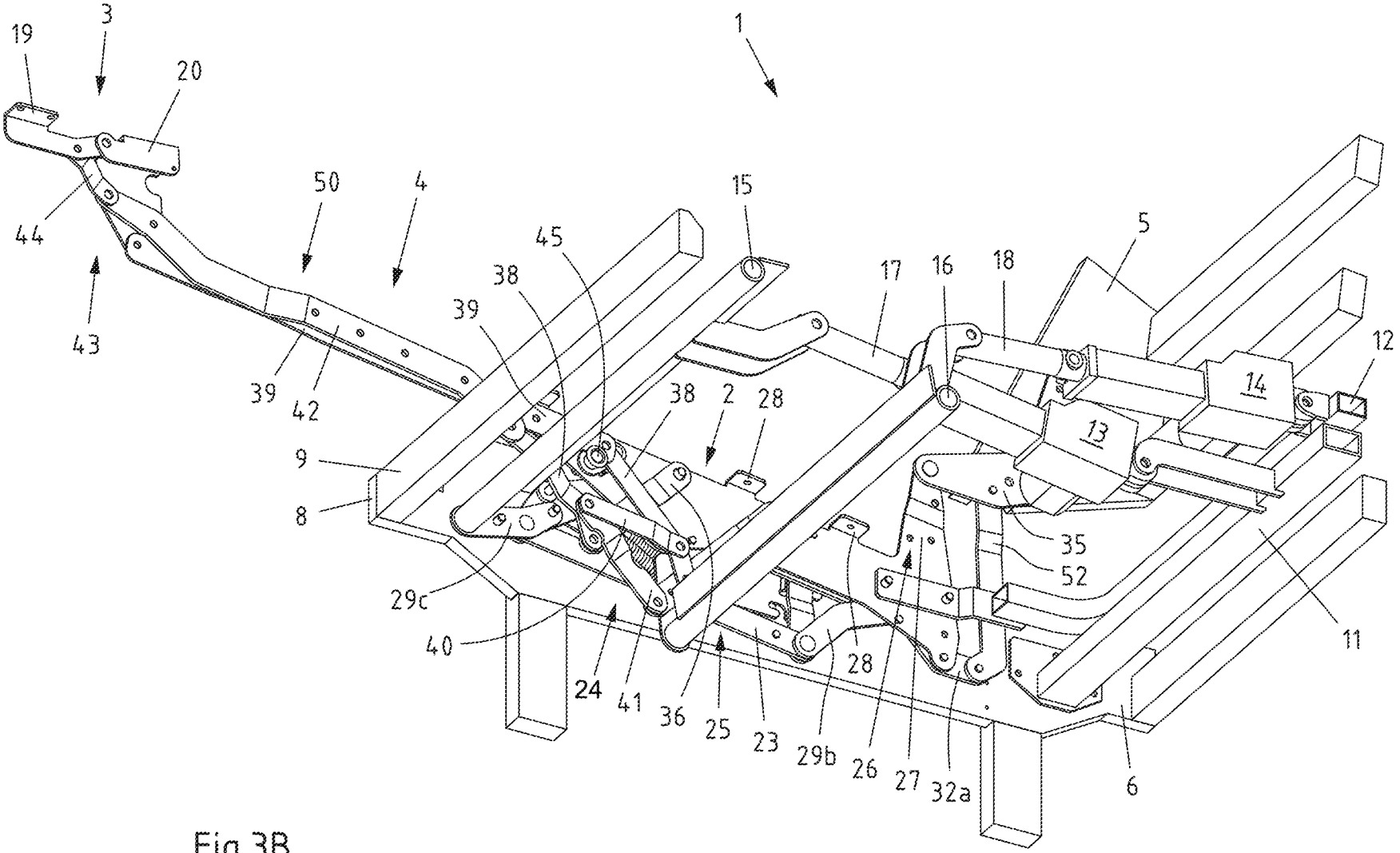
Figure 3C:
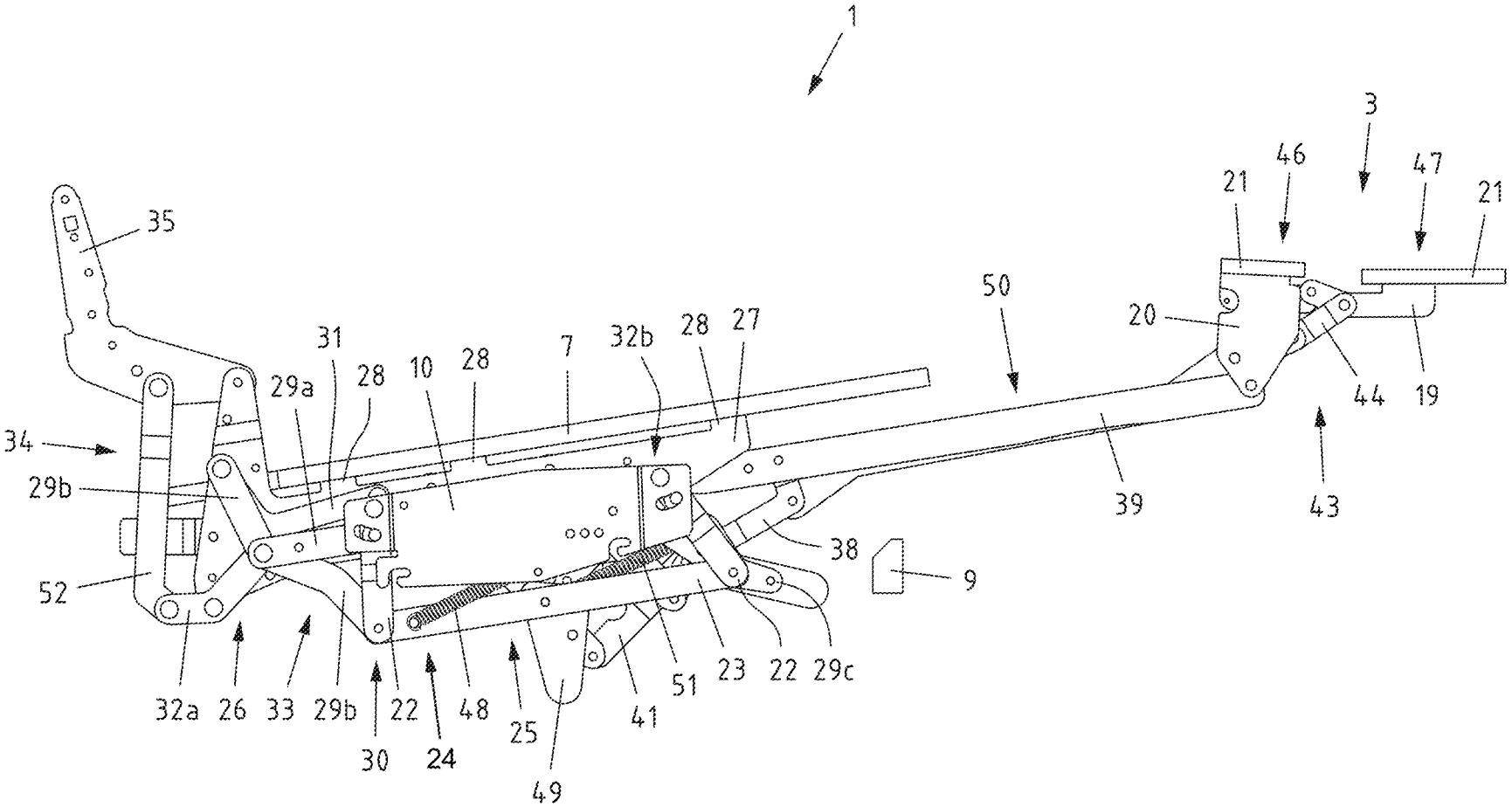

However, this subsequently changes due to the activation of the foot part drive 14, which therefore executes its drive rod 18, as represented in FIGS. 3A-C. The drive rod 18 of the foot part drive 14 displaces the foot part fitting 4 together with the foot part section 43 forwards, wherein the coupling strut 27, the back fitting 26 and the tilt fitting 25 at least substantially retain their positions. The traverse 16 connected to the foot part drive 14 is connected to the rear parallel lever 36 via a transmission plate 49 in a rotationally fixed manner with respect to the rear parallel lever 36. Driven via the traverse 16 and the transmission plate 49, the parallel levers 36 are thus swivelled forwards at least substantially parallel to one another with respect to the coupling strut 27. The tab lever 41, the drive levers 38 and the spacer lever 40 are in this case also adjusted forwards. Driven via these gears, the adjusting lever 39 and the control lever 42 are adjusted forwards in a roughly straight line.

Meanwhile, the adjusting lever 39 and the control lever 42 remain adjacent in a longitudinal section 50 in an at least substantially horizontal transverse direction and are arranged approximately parallel to one another in the longitudinal direction of the swivel fitting 2. The longitudinal section 50 extends, in the present case but not necessarily, over a distance of between 35 cm and 40 cm, namely in a longitudinal direction of the swivel fitting 2. When the foot part 3 has reached the forward use position according to FIGS. 3A-C, the longitudinal section 50 is positioned in a region of the seating furniture 1, which is arranged in front of the foot part 3, in particular in front of the foot part connection tilt region 20, in relation to the non-use position of the foot part 3. In the longitudinal section 50, the adjusting lever 39 and the control lever 42 are also inclined relative to one another by less than 15°, in this case by roughly 5° to 6°. In this case, this applies to the actual configuration of the adjusting lever 39 and of the control lever 42. However, it would also be conceivable that only two straight lines are inclined relative to one another by less than 15°, for example by roughly 5° to 6°. One of these straight lines then extends through the terminal articulated connections of the control lever 42, while the other straight line extends through the terminal articulated connections of the adjusting lever 39. In this case, the actual shaping of the adjusting lever 39 and of the control lever 42 is less important.

Despite the at least substantially parallel extension of adjusting lever 39 and control lever 42 to one another and despite the at least substantially common displacement of adjusting lever 39 and control lever 42, the adjusting lever 39 and the control lever 42 are adjusted to a certain extent relative to one another. This minor adjustment is converted in the foot part section 43 into a significant adjustment of the foot part connection swivel region 19 and of the foot part connection tilt region 20. Proceeding from the rear position of the swivel fitting 2 according to FIGS. 2A-C, the foot part connection swivel region 19 is first raised slightly rearwards and upwards, in particular while the foot part connection swivel region 19 is displaced forwards over the panel 9 of the seating furniture 1. Only after the adjusting lever 39 and the control lever 42 have been displaced forwards over roughly one third to two thirds, in particular roughly half, of the total adjustment travel of the adjusting lever 39 and control lever 42 is the further adjustment of the adjusting lever 39 and of the control lever 42 forwards converted into a swivelling of the foot part connection swivel region 19 forwards and upwards by roughly 180° and a tilting of the foot part connection tilt region 20 forwards and upwards by roughly 90°. The user of the seating furniture 1 can now comfortably rest their legs on the foot part 3 in the use position. The forces thereby acting on the swivel fitting 2 are partially dissipated via the support element 45 fixed stationarily to the coupling strut 27, on which support element 45 the rear region of the adjusting lever 39 rests. In the non-use position, the front region of the adjusting lever 39 together with the control lever 42 rests on the support element 45 in order to hold the foot part 3 securely in position.

In order to be able to adopt an even more comfortable position of the seating furniture 1 as required, the user can adjust the backrest 5 from the more upright position to a flatter position. For this purpose, the drive rod 17 of the tilt and back drive 13 is extended further forwards. This leads not only to a tilting of the backrest 5 backwards, but also to a displacement of the coupling strut 27 together with the foot part fitting 4 and the backrest 5 forwards with respect to the mounting section 10 of the swivel fitting 2. Adjustment takes place against the restoring force of a spring means 51 of the back fitting 26. In this way, the seating furniture 1 enters into the position represented in FIGS. 4A-C with the foot part 3 in a use position and the backrest 5 in a flatter orientation.

Figure 4A:
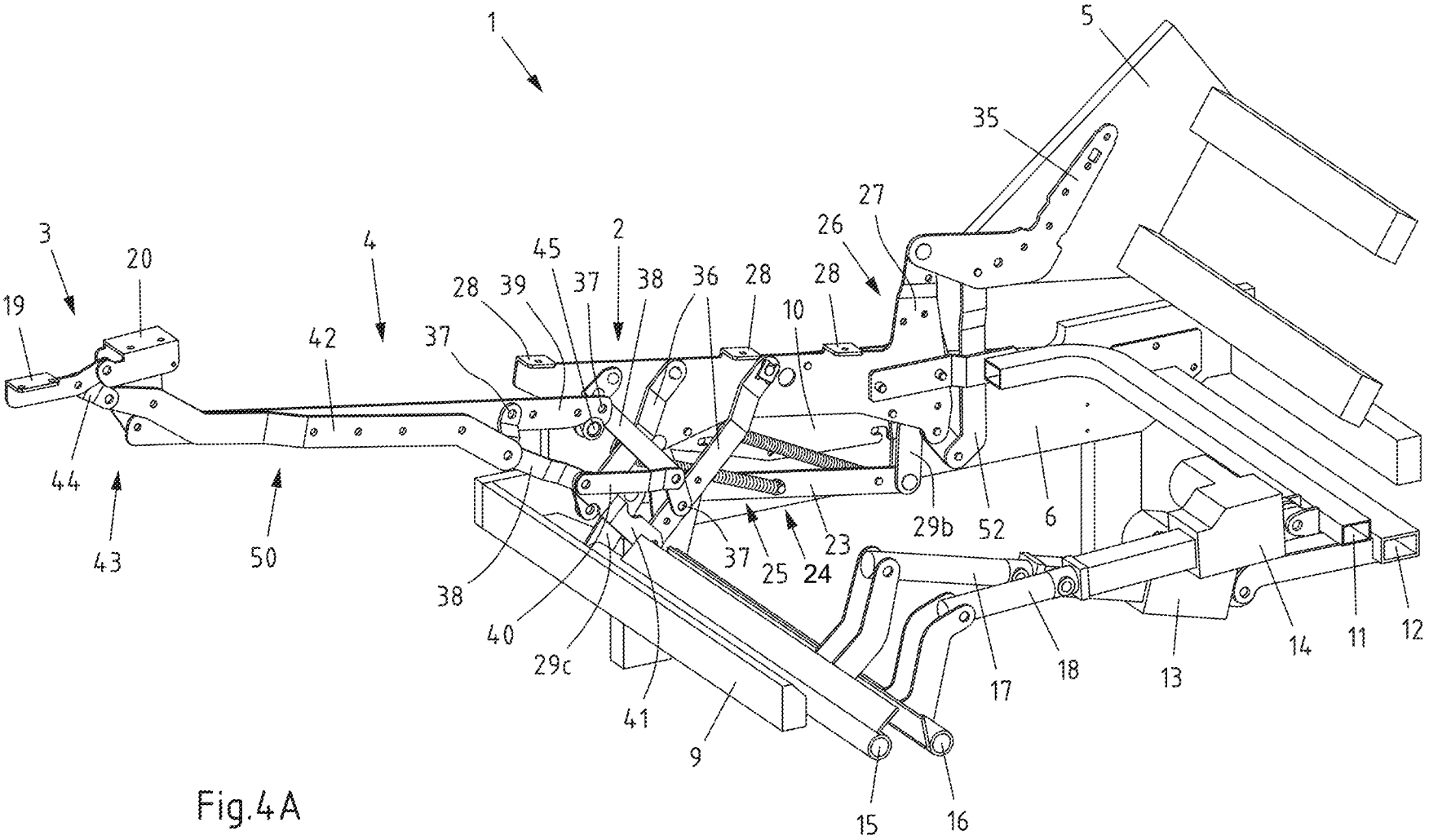
Figure 4B:
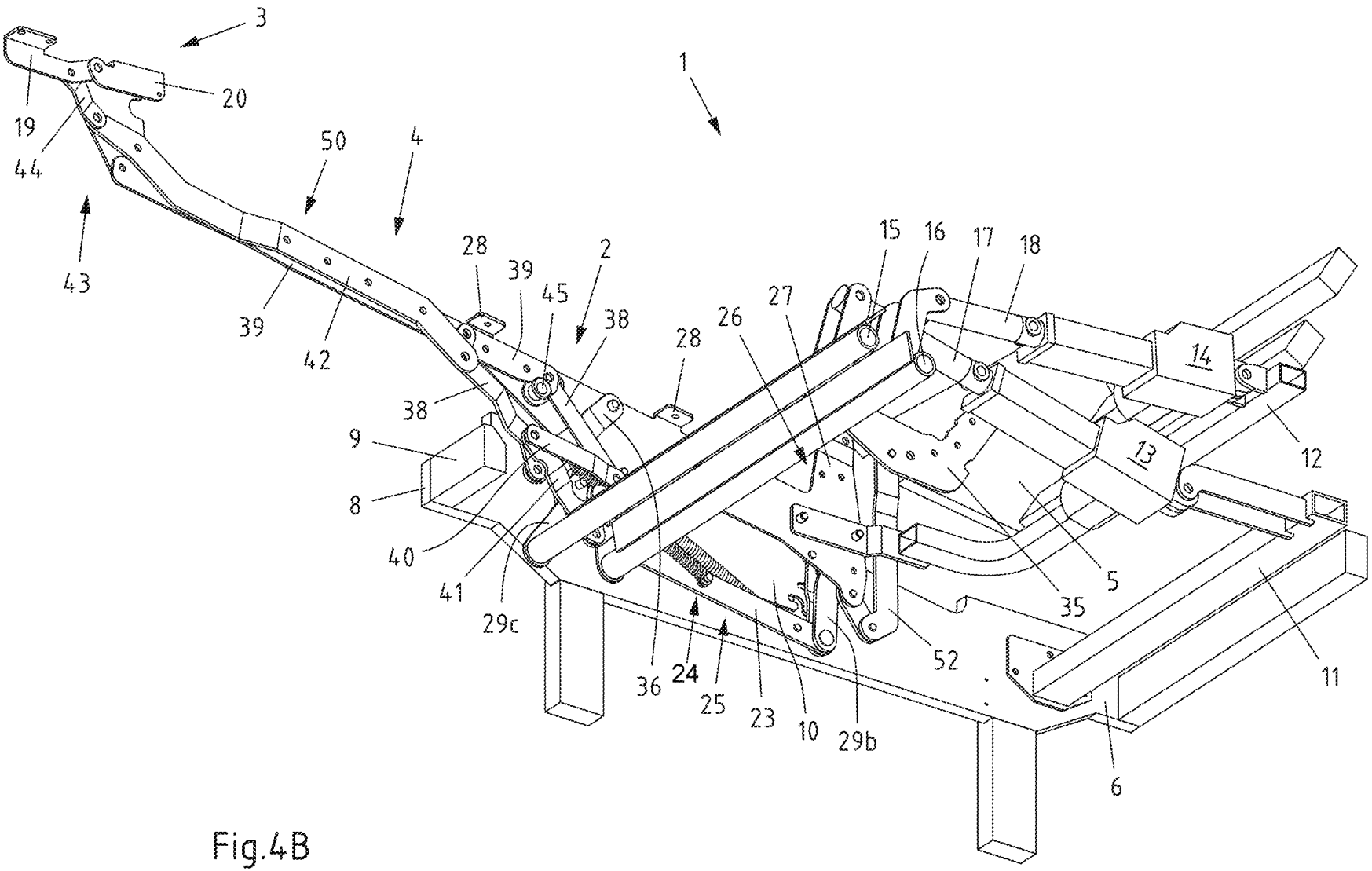
Figure 4C:
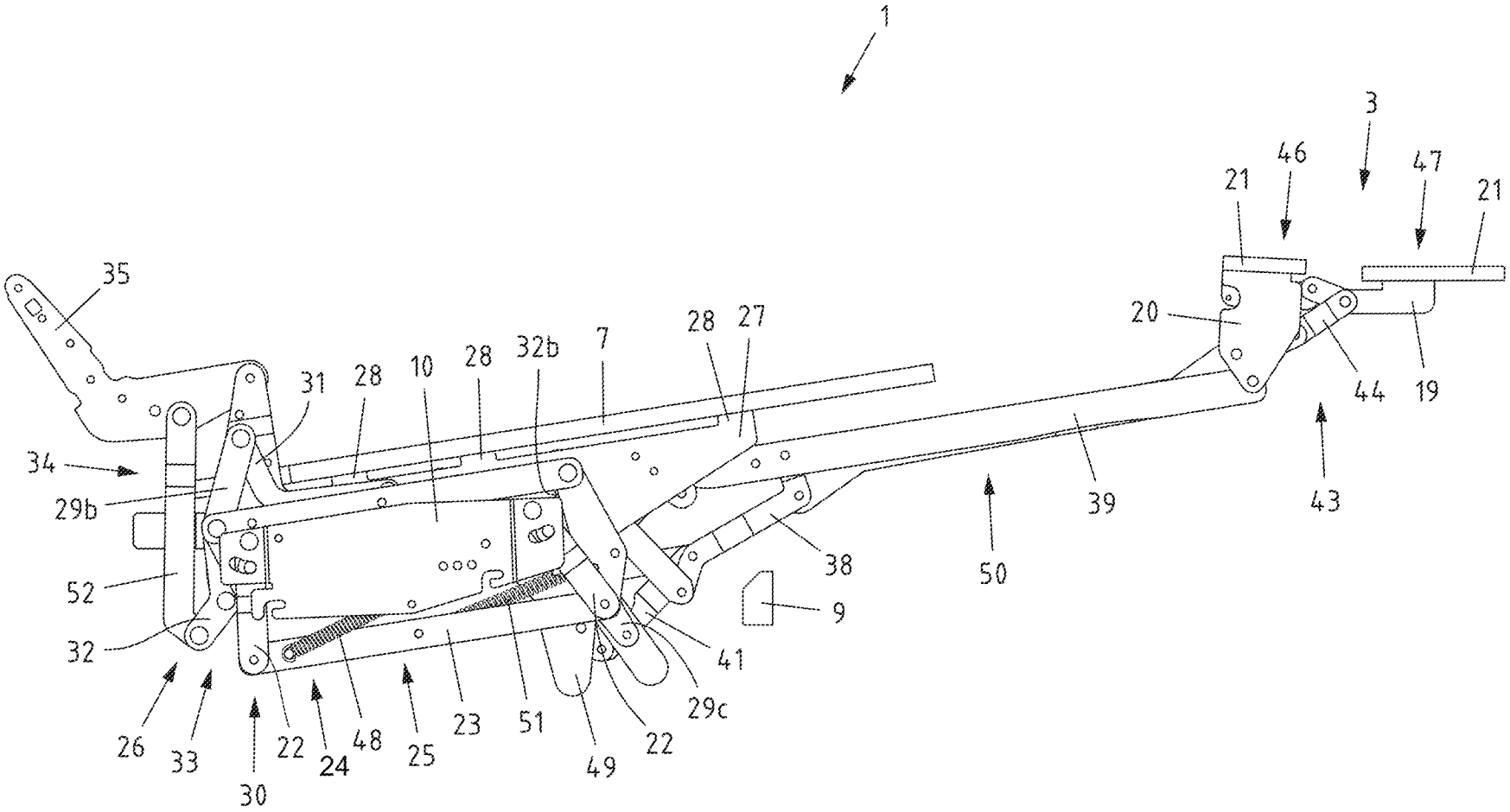

The seating furniture 1 and the swivel fitting 2 can be adjusted back from the position represented in FIGS. 4A-C in the reverse manner into the position represented in FIGS. 1A-C.

LIST OF REFERENCE NUMERALS

1 Seating furniture
2 Swivel fitting
3 Foot part
4 Foot part fitting
5 Backrest
6 Chassis
7 Seat
8 Side bolster
9 Panel
10 Mounting section
11 Cross member
12 Cross member
13 Tilt and back drive
14 Foot part drive
15 Traverse
16 Traverse
17 Drive rod
18 Drive rod
19 Foot part connection swivel region
20 Foot part connection tilt region
21 Board
22 Tilting lever
23 Connecting lever
24 Four-bar linkage
25 Tilt fitting
26 Back fitting
27 Coupling strut
28 Seat section
29*a-c* Swivel lever

30 Four-bar linkage
31 Coupling lever
32*a-b* Transmission lever
33 Four-bar linkage
34 Four-bar linkage
35 Back section
36 Parallel lever
37 Articulated connection
38 Drive lever
39 Adjusting lever
40 Spacer lever
41 Tab lever
42 Control lever
43 Foot part section
44 Handle lever
45 Support element
46 Part of the foot part
47 Part of the foot part
48 Spring means Tilt
49 Transmission plate
50 Longitudinal section
51 Spring means
52 Support lever

The invention claimed is:

1. A swivel fitting of seating furniture for adjusting a foot part from a retracted non-use position to an extended use position, with a mounting section for mounting on a chassis of the seating furniture, with a foot part section for mounting the foot part, with a foot part fitting for adjusting the foot part, wherein a foot part connection swivel region of the foot part section is positioned in front of a foot part connection tilt region of the foot part section in the use position, wherein the foot part connection tilt region of the foot part section is positioned in front of the foot part connection swivel region of the foot part section in the in the non-use position, and wherein the foot part connection swivel region and the foot part connection tilt region are held via an adjusting lever and a control lever of the foot part fitting and are adjustable relative to one another, wherein during the entire adjustment from the non-use position to the use position and back, the adjusting lever and the control lever are arranged extending adjacent to one another in a common longitudinal section, which extends at least over 20 cm in the longitudinal direction of the swivel fitting, in a direction at least substantially perpendicular to the adjusting lever or to the control lever, wherein, in the use position, the longitudinal section is positioned in front of a location occupied by the foot part connection tilt region in the non-use position, and wherein in the longitudinal section, a longitudinal extension of the adjusting lever is inclined by less than 15° relative to a longitudinal extension of the control lever.

2. The swivel fitting according to claim 1, wherein the longitudinal section extends over at least 25 cm to 35 cm, and wherein in the longitudinal section, the longitudinal extension of the adjusting lever is inclined by less than 12° to 8°, with respect to the longitudinal extension of the control lever.

3. The swivel fitting according to claim 1, wherein the foot part connection tilt region, the foot part connection swivel region, the adjusting lever and the control lever are connected to one another via a five-bar linkage, and wherein the five-bar linkage has a handle lever connecting the control lever directly to the foot part connection swivel region by bypassing the foot part connection tilt region.

4. The swivel fitting according to claim 1, wherein the foot part fitting is fixed on the mounting section so as to be adjustable with respect to the mounting section via a tilt fitting for tilting the foot part fitting, and wherein the mounting section is designed as part of the tilt fitting.

5. The swivel fitting according to claim 4, wherein the mounting section and the tilt fitting form a four-bar linkage comprising two tilting levers and a connecting lever, and wherein the tilt fitting is connected to a back fitting for adjusting a backrest from a more upright position to a flatter position relative to the chassis.

6. The swivel fitting according to claim 4, wherein the tilt fitting for tilting the foot part fitting and a back fitting for adjusting a backrest are motor-driven and wherein the motorized drive is designed to first adjust the tilt fitting for tilting the foot part fitting from the non-use position and then to adjust the back fitting from the more upright position to a flatter position.

7. The swivel fitting according to claim 4, wherein the tilt fitting or a back fitting has a common coupling strut with the foot part fitting and wherein, stationarily in relation to the coupling strut, a seat section is provided for the adjustable mounting of a seat relative to the chassis.

8. The swivel fitting according to claim 5, wherein the back fitting connects the connecting lever to the coupling strut via a four-bar linkage and a back section for mounting a backrest is connected to the coupling strut via the four-bar linkage.

9. The swivel fitting according to claim 8, wherein the four-bar linkage for connecting a back section to the coupling strut and the four-bar linkage for connecting the connecting lever to the coupling strut have a common transmission lever.

10. The swivel fitting according to claim 7, wherein the foot part fitting is connected to the coupling strut via a five-bar linkage and wherein the five-bar linkage is connected to the coupling strut with two parallel levers, which are always aligned at least substantially parallel to one another.

11. The swivel fitting according to claim 10, wherein each parallel lever is connected to the adjusting lever via two articulated connections via a separate drive lever and wherein the two drive levers are connected to a common spacer lever via two articulated connections.

12. The swivel fitting according to claim 11, wherein a drive lever is designed at least substantially Z-shaped with an upper leg connected to the adjusting lever, with a lower leg connected to the parallel lever and with a central leg connected to the upper leg and to the lower leg and in that the connection region of the central leg and of the upper leg is hinged on the adjusting lever in an articulated manner.

13. The swivel fitting according to claim 12, wherein the connection region of the central leg and of the lower leg is hinged on the spacer lever in an articulated manner and wherein a joint of the spacer lever of the five-bar linkage of the foot part fitting is provided on the connection region of the central leg and of the lower leg.

14. The swivel fitting according to claim 1, wherein the foot part fitting for adjusting the foot part is motor-driven via a motorized foot part drive and wherein the tilt fitting and a back fitting is driven via a motorized tilt or back drive.

15. A seating furniture with a chassis, two side bolsters and at least one swivel fitting, wherein the at least one swivel fitting is mounted on the chassis via a mounting section and wherein the side bolsters are connected via a stationary and continuous panel, wherein the at least one swivel fitting is designed according to claim 1 and in that the foot part section in the non-use position is arranged at least in sections in the horizontal direction behind the panel.

16. The seating furniture according to claim 15, wherein the at least one swivel fitting is arranged above the panel in the use position.

17. The seating furniture according to claim 15, wherein two swivel fittings provided on opposing sides of the chassis and connected to the chassis on opposing sides are provided according to claim 1 and in that the foot part sections in the non-use position together support a foot part arranged at least in sections in a horizontal direction behind the panel.

18. The seating furniture according to claim 17, wherein the two swivel fittings, are arranged above the panel in the use position.

19. The seating furniture according to claim 15, wherein a motorized foot part drive is coupled to the foot part fitting for adjusting the foot part, a motorized tilt is coupled to the tilt fitting for tilting the tilt fitting, and a motorized back drive is coupled to the back fitting for adjusting the backrest.

* * * * *